US008912858B2

(12) United States Patent
Dayan et al.

(10) Patent No.: US 8,912,858 B2
(45) Date of Patent: Dec. 16, 2014

(54) INTERFACING BETWEEN AN INTEGRATED CIRCUIT AND A WAVEGUIDE THROUGH A CAVITY LOCATED IN A SOFT LAMINATE

(75) Inventors: Elad Dayan, Beit-Dagan (IL); Amir Shmuel, Nofit (IL); Yigal Leiba, Holon (IL); Baruch Schwarz, RaAnana (IL)

(73) Assignee: Siklu Communication Ltd., Petach-Tikva (IL)

( * ) Notice: Subject to any disclaimer, the term of this patent is extended or adjusted under 35 U.S.C. 154(b) by 0 days.

(21) Appl. No.: 12/554,987

(22) Filed: Sep. 8, 2009

(65) Prior Publication Data

US 2011/0057741 A1 Mar. 10, 2011

(51) Int. Cl.
*H01P 5/107* (2006.01)

(52) U.S. Cl.
CPC ..... *H01P 5/107* (2013.01)
USPC ..... 333/26; 333/247

(58) Field of Classification Search
CPC ..... H01P 5/107
USPC ..... 333/26, 247, 33
See application file for complete search history.

(56) References Cited

U.S. PATENT DOCUMENTS

| | | | | |
|---|---|---|---|---|
| 3,255,408 | A | 6/1966 | Walker | |
| 5,235,300 | A * | 8/1993 | Chan et al. | 333/247 |
| 5,384,557 | A | 1/1995 | Yoshida et al. | |
| 5,475,394 | A | 12/1995 | Kohls et al. | |
| 5,808,519 | A * | 9/1998 | Gotoh et al. | 333/26 |
| 5,903,239 | A * | 5/1999 | Takahashi et al. | 343/700 MS |
| 5,982,250 | A * | 11/1999 | Hung et al. | 333/26 |
| 6,320,543 | B1 | 11/2001 | Ohata et al. | |
| 6,356,173 | B1 * | 3/2002 | Nagata et al. | 333/247 |
| 6,359,590 | B2 | 3/2002 | Takenoshita | |
| 6,572,955 | B2 | 6/2003 | Terashi et al. | |
| 6,573,808 | B1 | 6/2003 | Burin | |
| 6,608,535 | B2 | 8/2003 | Sherman et al. | |
| 6,870,438 | B1 * | 3/2005 | Shino et al. | 333/26 |
| 7,109,122 | B2 | 9/2006 | Moroz | |
| 7,911,292 | B2 * | 3/2011 | Byun et al. | 333/26 |
| 2003/0012006 | A1 | 1/2003 | Silverman | |
| 2003/0076188 | A1 * | 4/2003 | Dawn et al. | 333/26 |
| 2004/0041657 | A1 | 3/2004 | Paakonen et al. | |
| 2004/0145426 | A1 | 7/2004 | Wu et al. | |

(Continued)

FOREIGN PATENT DOCUMENTS

WO WO 2011/030277 3/2011

OTHER PUBLICATIONS

International Search Report and the Written Opinion Dated Apr. 6, 2011 From the International Searching Authority Re. Application No. PCT/IB2010/054004.

(Continued)

*Primary Examiner* — Benny Lee

(57) ABSTRACT

A low-loss interface between a mm-wave integrated circuit and a waveguide comprises a surface having a contact location for said integrated circuit and a waveguide location for fixing a waveguide thereon; a transmission line extending along said surface from said contact location to the waveguide location and extending into the waveguide location as a waveguide feed; and a connection bump on a surface of the mm-wave integrated circuit. The mm-wave integrated circuit RFIC is connected to the surface at the contact location through the connection bump, such as to connect a signal output of the RFIC to the transmission line, thereby providing said low loss interface.

17 Claims, 4 Drawing Sheets

(56) References Cited

U.S. PATENT DOCUMENTS

| | | | | |
|---|---|---|---|---|
| 2005/0024166 | A1 | 2/2005 | Ammar et al. | |
| 2006/0097818 | A1 * | 5/2006 | Camiade et al. | 333/26 |
| 2006/0256016 | A1 | 11/2006 | Wu et al. | |
| 2007/0085626 | A1 | 4/2007 | Lee et al. | |
| 2007/0109070 | A1 | 5/2007 | Singh | |
| 2008/0266196 | A1 | 10/2008 | Shi | |
| 2009/0206473 | A1 | 8/2009 | Lopez et al. | |
| 2009/0207090 | A1 | 8/2009 | Pettus | |

OTHER PUBLICATIONS

Clenet et al. "Array of Laminated Waveguides for Implementation in LTCC Technology", Technical Memorandum, Defense Research and Development Canada, DRDC Ottawa TM 2006-227, 80 P., Nov. 2006. p. 1-4.

* cited by examiner

INTERFACING BETWEEN AN INTEGRATED CIRCUIT AND A WAVEGUIDE THROUGH A CAVITY LOCATED IN A SOFT LAMINATE

FIELD AND BACKGROUND OF THE INVENTION

The present invention relates to a device and method for interfacing between an integrated circuit and a waveguide and, more particularly, but not exclusively to providing an interface that is efficient at radio and mm-wave frequencies.

A problem arises as to how to create a low loss interface between a millimeter-wave RFIC and a wave-guide.

Current IC production techniques allow a number of types of mechanical structures that can be used to interface IC signals. In order to drive a signal in and out of a wave-guide the mechanical structure needs to comply with specific electromagnetic requirements. In order to drive a millimeter-wave signal between the IC signal interface and the wave-guide's own interface, another mechanical structure is required, the structure having its own electromagnetic requirements in order to drive the electromagnetic signal with minimal loss of signal power.

The difficulty existing today is that the known interfacing techniques still dissipate the signal's power and are relatively complicated and costly to implement. The systems in use today for connecting the integrated circuit to the PCB are wire bonding and tape automatic bonding. Wire bonding uses gold, aluminium or copper wires to connect an IC to a substrate. The bonding is flexible and tolerant of thermal expansion and is also relatively inexpensive. Parasitic effects such as skin effect resistance, radiation loss, mutual coupling between bonding wires, and wire inductances are however present, and difficult to control or model.

Tape automated bonding (TAB) uses patterned metal leads to connect between IC and substrate. An IC is first attached to an inner rim of the patterned leads using gold, aluminium or solder bumps. The attached IC is then mounted on the substrate.

TAB technology can be highly automated, is very precise and allows for gang bonding—meaning that all leads are bonded simultaneously. However the metal leads are of non-uniform width and are closely spaced, leading to electrical characteristics which are difficult to predict or model. TAB technology is also relatively expensive.

U.S. Pat. No. 7,109,122 is an example of the kind of interface according to the current art which still dissipates signal power.

US Patent Application Publication No. 2008/0266196 deals with details of a conventional waveguide feed mechanism.

SUMMARY OF THE INVENTION

According to one aspect of the present invention there is provided a low-loss interface between a mm-wave integrated circuit and a waveguide. The interface is constructed by:

providing a surface having a contact location for the integrated circuit and a waveguide location for fixing a waveguide thereon;

providing a transmission line extending along the surface from the contact location substantially to the waveguide location and extending into the waveguide location as a waveguide feed;

providing a plurality of connection bumps on a surface of the mm-wave integrated circuit; and connecting the mm-wave integrated circuit to the surface at the contact location through the connection bumps, such that a first of the connection bumps connects a signal output of the mm-wave integrated circuit to the transmission line, thereby providing the low loss interface.

In an embodiment, the plurality of connection bumps are connection bumps of a flip chip interconnection system.

In an embodiment, the mm-wave integrated circuit comprises an interface for a transmission line on a lower surface thereof, and wherein the signal output is a signal output of the transmission line.

In an embodiment, a waveguide location comprises a cavity for receiving the waveguide.

An embodiment may involve constructing a waveguide backshort around the cavity to reflect energy into the waveguide.

An embodiment may comprise constructing the waveguide backshort from a metal casing over the surface.

In an embodiment, the transmission line is mounted on a millimeter wave substrate, and wherein a ground connection to the mm-wave integrated circuit is made through the millimeter wave substrate to another of the connection bumps.

In an embodiment, the transmission line is mounted on a millimeter wave substrate and comprising implementing the cavity as part of the millimeter wave substrate.

The cavity may be plated.

According to an aspect of the present invention there is provided a low-loss interface between a mm-wave integrated circuit and a waveguide, comprising:

a surface having a contact location for the integrated circuit and a waveguide location for fixing a waveguide thereon;

a transmission line extending along the surface from the contact location substantially to the waveguide location and extending into the waveguide location as a waveguide feed;

a plurality of connection bumps on a surface of the mm-wave integrated circuit providing a connection between the mm-wave integrated circuit and the surface at the contact location, such that a first one of the connection bumps connects a signal output of the mm-wave integrated circuit to the transmission line, thereby providing the low loss interface.

According to a further aspect of the present invention there is provided a method of manufacturing a connection for a waveguide to a PCB, comprising:

printing on a low loss substrate a feed, the feed being an extension of a transmission line;

cutting a cavity under said feed;

providing a metal plating around said cavity;

laminating the low loss substrate onto the PCB after said metal plating has been provided, such that said metal plating extends between said laminated layers about said cavity to a first extent about said cavity, placing a metal cap over the substrate, the metal cap being electrically connected to the metal plating, and placing the waveguide in contact with the cavity such that the cavity forms a continuation with the waveguide.

The method may comprise connecting said metal cap to said metal plating using vias, the vias being within said first extent.

In an embodiment, the waveguide is for carrying a signal of a predetermined wavelength and an alternative to the use of vias is to provide a shoulder is added to said metal cap, said shoulder being a quarter of the predetermined wavelength.

The waveguide may be for carrying a signal of a predetermined wavelength and the PCB may then be a quarter of the predetermined wavelength.

Unless otherwise defined, all technical and scientific terms used herein have the same meaning as commonly understood by one of ordinary skill in the art to which this invention belongs. The materials, methods, and examples provided herein are illustrative only and not intended to be limiting.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Implementation of the method and/or system of embodiments of the invention can involve performing or completing selected tasks manually, automatically, or a combination thereof. This refers in particular to tasks involving the RFIC itself.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DETAILED DESCRIPTION OF THE PREFERRED EMBODIMENTS

Figures 1, 2:
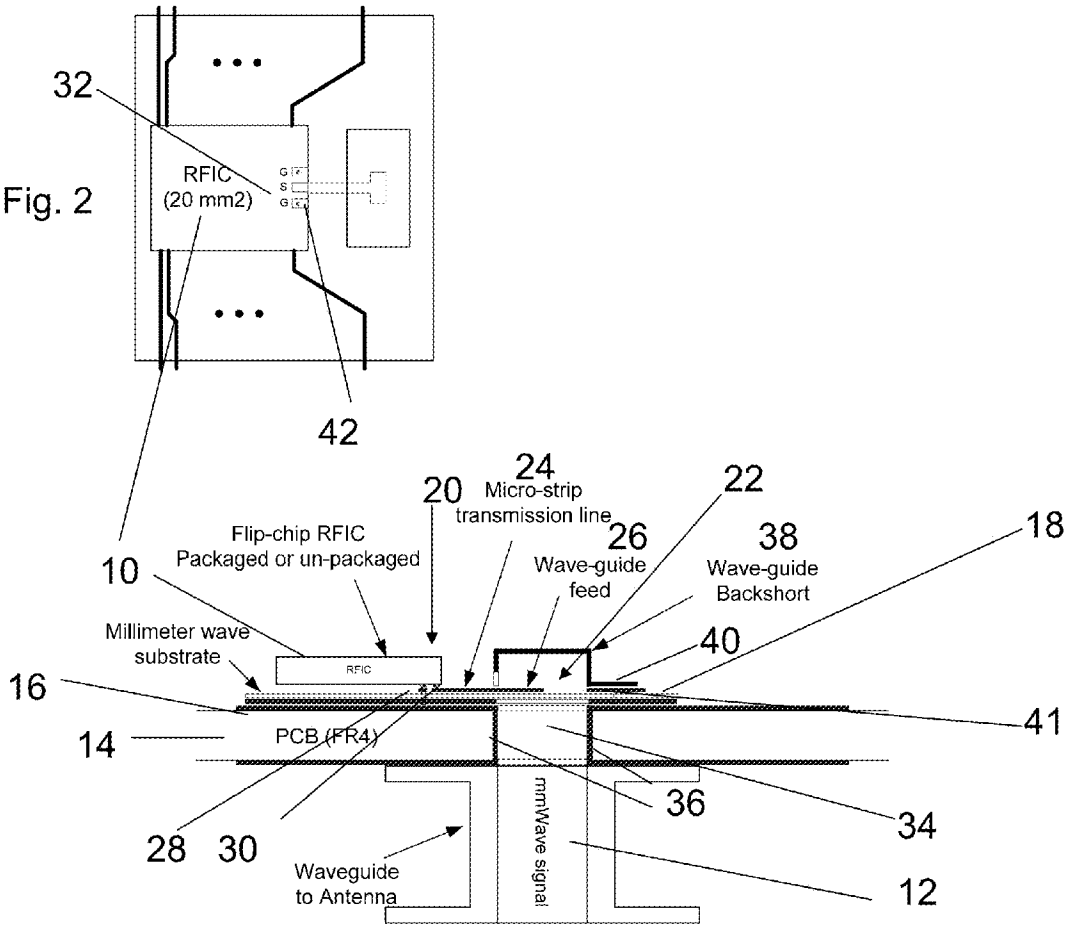
FIG. 1 is a simplified diagram showing a cross section of an RFIC, PCB RF interface and waveguide according to the present embodiments.
FIG. 2 shows a view from below of an RFIC having an interface for a ground-signal-ground transmission line on its underside, for use with the RF interface of the device of FIG. 1.

The present embodiments comprise the use of flip chip style interconnection bumps from an underside ground-signal-ground interface of an RFIC to a microstrip transmission line to link via a waveguide feed to a waveguide, thereby providing an efficient interface between the RFIC and the waveguide. The connection bump is located over the ground-signal-ground signal output of the RFIC and over the microstrip transmission line and forms a connection therebetween. The dielectric overlap between the RFIC and the PCB may be minimized.

The principles and operation of an apparatus and method according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Reference is now made to FIG. 1 which illustrates a low-loss interface between a mm-wave integrated circuit RFIC 10 and a waveguide 12. The interface comprises a PCB surface 14 on which is a ground layer 16 and a millimeter wave substrate 18. The surface has a contact location 20 for the integrated circuit. The surface further has a waveguide location 22 for fixing the waveguide 12 into the PCB 14 to take a signal (mmWave signal) to an antenna—not shown.

A microstrip transmission line 24 extends along the surface from contact location 20 to waveguide location 22. The transmission line extends into the waveguide location 22 as a waveguide feed 26. The waveguide feed, as an extension of the microstrip transmission line, may be, or may be based on, a conventional monopole feed.

Connection bumps 28 and 30 are part of a flip chip connection system and are located on the contact side of the RFIC 10. An exemplary RFIC is shown as having a surface area of 20 $mm^2$. The connection bumps make a connection between the RFIC 10 and the surface at contact location 20. The connection is direct and there are no intervening wires. The bump height may be minimized, in order to avoid detuning effects and to have low parasitic inductance. One of the connection bumps 28 connects a signal output 32 (S, FIG. 2) of the mm-wave integrated circuit 10 to transmission line 24, thus providing the low loss interface. The signal output has ground connections G on either side.

That is to say, the RFIC interface is based on flip chip style interconnection bumps. The microwave signal transmission line comprises three bumps organized in a Ground-Signal-Ground structure. The Ground-Signal-Ground structure is very natural for implementation of analog circuitry inside the RFIC and yields a transmission line with characteristic impedance of between 100 and 170 Ohm and typically at about 150 Ohm at a physical length in a typical range of 30-80 μm and in particular about 40 μm.

The same Ground-Signal-Ground structure implemented using wire-bonds may create a transmission line with the same characteristic impedance but with a physical length in the range of 200-400 μm and most typically 300 μm. The reduced length of the transmission line using flip-chip may enable a much simpler matching structure using the present embodiments.

The RFIC interface can also be of a balanced nature, meaning be based on two complementary signal lines.

As mentioned above, the connection bumps are part of a flip chip interconnection system, and the chip 10 may be packaged or unpackaged. The flip chip connections allow for wafer level packaging so that the resulting structure does not have to be sealed.

Flip chip connections provide short and stable connections. Nevertheless, the use of flip chip connections is not straightforward, and issues arise that include parasitic reactance at the bump interconnection, a detuning effect on the RFIC circuits and excitation of parasitic substrate modes.

The number of connection bumps is preferably minimized in order to reduce mutual coupling effects.

Figure 3:
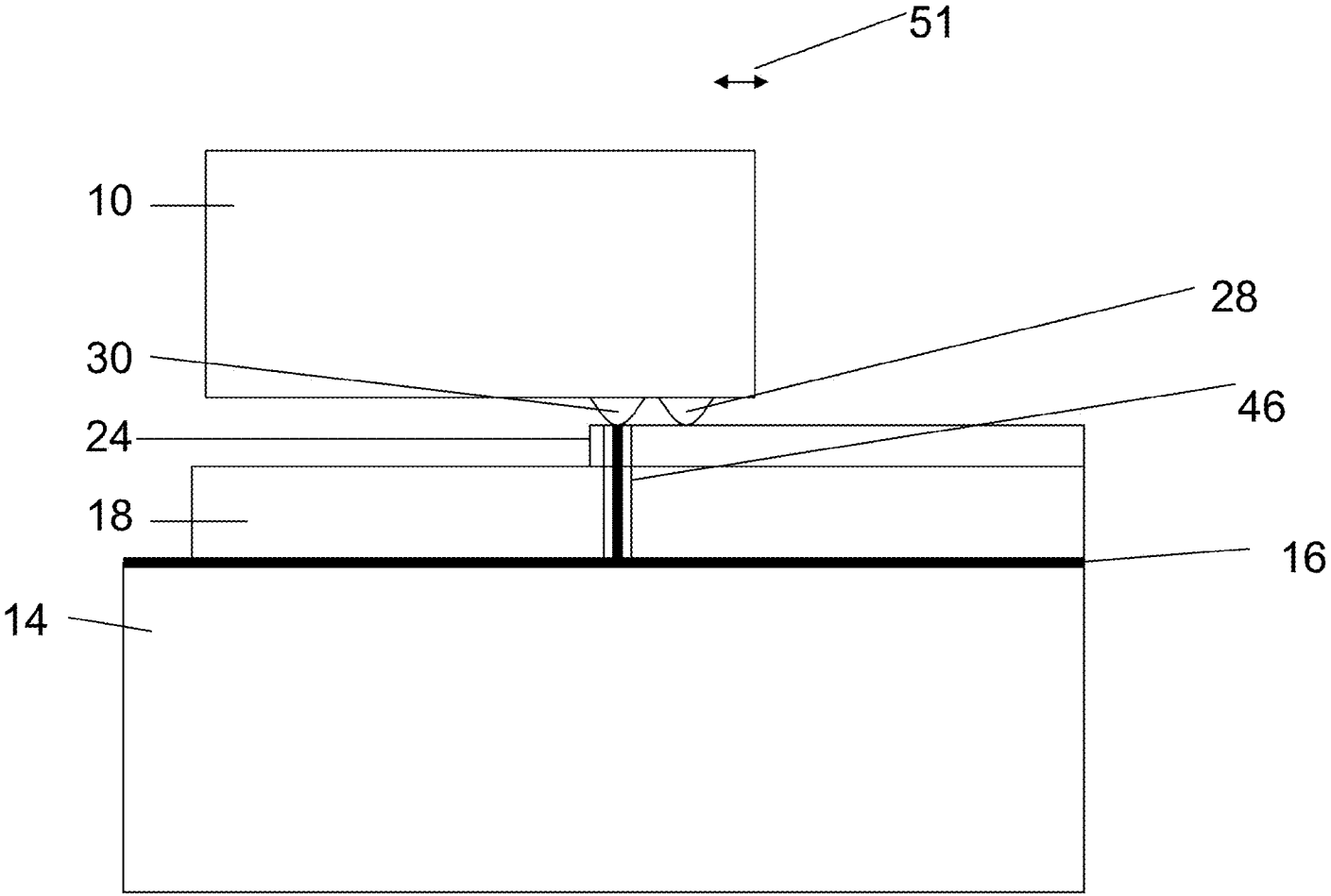
FIG. 3 is an enlarged view of part of FIG. 1, showing in greater detail the connection between the ground-signal-ground interface of the RFIC and the microstrip transmission line and PCB.

The bump diameter and dielectric overlap indicated by arrow 51 in FIG. 3 may be minimized to reduce reflection at the interconnection. A suitable diameter for the bump may be approximately 100 μm and the overlap may be of the order of magnitude of 200 μm although the overlap is affected linearly by the output power, and depends on the way in which the RFIC is laid out, for example whether the bumps are on the floor of the chip towards the wall or whether they are set further within.

The waveguide location 22 comprises a cavity 34 which extends into the PCB 14 and the ground layer 16, and serves for receiving the waveguide 12. The walls of the PCB around the cavity may be plated with plating 36, which is a continuation of the ground layer 16.

An alternative technique, based on having a PCB thickness of quarter of a wave-length, allows the cavity to be either plated or unplated.

The waveguide location may further comprise a waveguide backshort 38 around the cavity to reflect energy into said waveguide. The backshort 38 may be constructed from a metal casing 40 extending from the PCB surface. The metal casing 40 may be connected to the ground layer 16 via connection 41 through the millimeter wave substrate 18 and preferably back to the ground layer 16.

The transmission line is mounted, that is typically printed, on millimeter wave substrate 18. Reference is now made to FIG. 3, which is an enlarged schematic view of the connection between the ground-signal-ground interface of the RFIC and the microstrip transmission line and PCB Parts that are the same as in FIG. 1 are given the same reference numerals and are not described again except as necessary for an understanding of FIG. 3.

RFIC 10 may have numerous connection bumps, of which only 2 are illustrated. These are respectively located over the ground and signal outputs of the ground-signal-ground interface that is provided on the underside of the RFIC 10. The underside of the RFIC, showing the ground-signal-ground interface, is as illustrated in FIG. 2 and discussed above. The PCB surface is labeled 14.

As explained, the bump 28 that is located over the signal output is electrically connected to the microstrip transmission line 24.

A ground connection is made from the ground 42 of the chip ground-signal-ground interface (shown in FIG. 2) through another of the connection bumps 30, to the ground layer 16. The connection passes through a tunnel 46 made into the millimeter wave substrate 18 so that the ground layer 16 may be connected to connection bump 30.

The cavity 34 may be a part of or extend into the millimeter wave substrate, with the ground layer and millimeter wave substrate being cut away from within the cavity.

Arrow 51 illustrates the dielectric overlap between the RFIC 10 and the microwave transmission line 24. The dielectric overlap is preferably minimized in order to reduce reflection.

Figure 4:
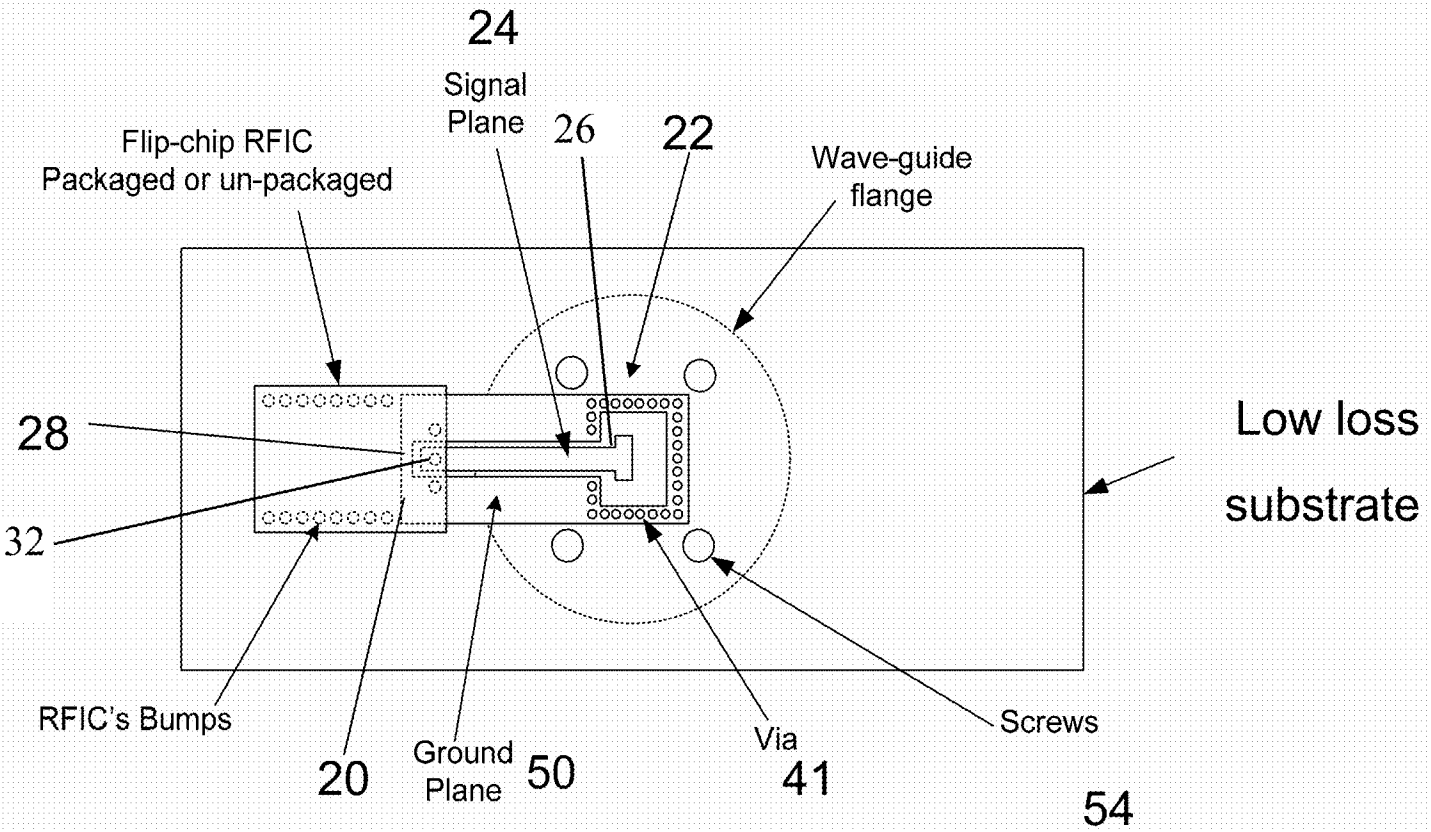
FIG. 4 is a simplified diagram showing an alternative construction to that shown in FIG. 2 according to a second preferred embodiment of the present invention.

Reference is now made to FIG. 4, which is an alternative embodiment of the device shown in FIG. 2. In FIG. 4, transmission line 24 extends along the surface from contact location 20 below a flip-chip RFIC, whether packaged or unpackaged, and having RFIC bumps, through a signal plane to waveguide location 22 within a waveguide flange. The transmission line extends into the waveguide location 22 as a waveguide feed 26. The waveguide feed, as an extension of the microstrip transmission line, may be, or may be based on, a conventional monopole feed.

Other types of possible waveguide-feeds include a tapered-slotline-probe. The probe may be based on a balanced drive and a radiating-slot, and thus eliminate the need for the back-short 38.

A method of construction of the embodiment of FIG. 4 is discussed below.

Connection bumps 28 and 30 (FIG. 3) are part of a flip chip connection system and are located on the contact side of the RFIC 10. The connection bumps make a connection between the RFIC 10 and the surface at contact location 20. The connection is direct and there are no intervening wires. The bump height may be minimized, in order to avoid detuning effects and to have low parasitic inductance. One of the connection bumps 28 connects a signal output 32 of the mm-wave integrated circuit 10 to transmission line 24, thus providing the low loss interface. Ground plane 50 surrounds the transmission line 24 so that in this embodiment, no tunneling is required.

Figure 5:
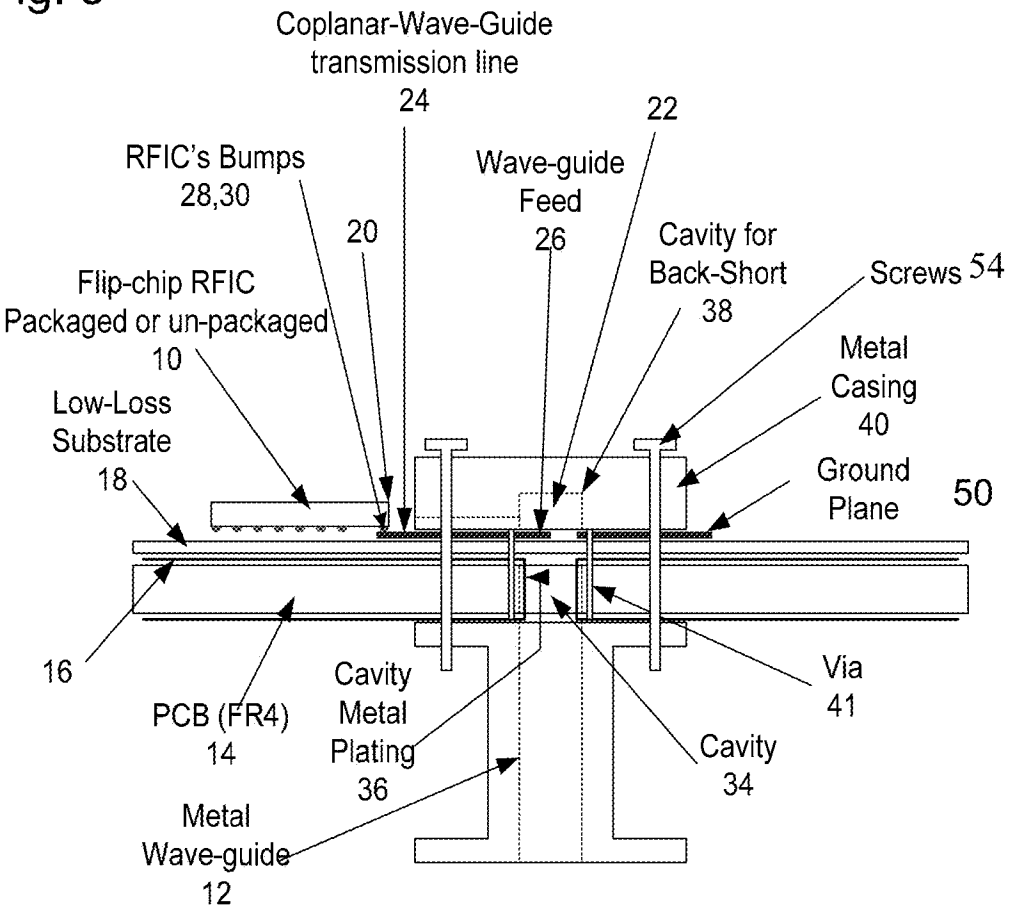
FIG. 5 is a simplified diagram showing a cross-section of the embodiment of FIG. 4.

Vias 41 connect the ground plane 50 to the metallic coating around the waveguide, as shown in greater detail with respect to FIG. 5. Screws 54 hold the parts together.

One purpose of the structure of the present embodiment is to provide cost reduction in the construction of an efficient interface.

To this end, the wave-guide interface serves to facilitate a transformation from the CPWG structure to the waveguide, which waveguide has metallic walls. In order to have a low-cost implementation of such a transformation medium, the implementation thereof is based on the same substrate holding the RFIC and the CPWG. The transformation medium is composed of the following:

- The wave-guide feed 26 serves as the Signal line of the CPWG extending into the wave-guide 12 and terminated for minimum reflected power.
- The Ground signal of the CPWG is connected to the body of the wave-guide, whether by being continuous with the plating of the waveguide as in FIG. 1 or by being connected through the vias 41 as per the embodiments of FIGS. 4 and 5 respectively.
- The Back-short 38 comprises the end termination of the wave-guide on one side. The back-short is implemented by a metal cap with a cavity of depth equivalent to about quarter wave-length.
- The back-short 38 may be extended to cover the entire RFIC for mechanical protection.
- A metal plated cavity cut into the surface of the PCB, shown as an FR-4 laminate in FIG. 1, may act as an extension of the metal wave-guide. In order to reduce the manufacturing cost of the substrate the cavity may be milled and plated at the FR-4 substrate as a regular via 41 prior to the lamination. This implies that the via is bonded through the low-loss substrate or layer. Thus the via connects the ground surface of the CPWG to the metal plating of the cavity to have a continuous wave-guide structure.
- An alternative to using via 41 can be to use shoulders being quarter wave-length extensions of backshort 38. The shoulders extend outwards from the circumference or perimeter of the cavity for back short 38. The use of shoulders allows an open face of the back-short to provide a grounding connection at the inner face of the back-short. Thus via 41 is no longer necessary.
- Screws 54 may be used to connect together the metal back-short, the substrate and the metal wave-guide together to form a rigid structure. Alternatively, bolts, rivets and bonding as well as other fixture possibilities may be suitable as well.

A transmission line 24 is thus provided between the RFIC interface and the wave-guide interface. In order to have a low-cost transmission line implementation the structure of the present embodiment may be based on a single layer of low-loss, soft or organic laminates such as Rogers 4350B, or a Taconic radio frequency laminate reinforced by low-cost FR4 material. Such material of course does not participate in the electromagnetic signal path. The selected wave-guide structure is a Grounded-Coplanar-Waveguide (CPWG). The Ground-Signal-Ground native structure of the top layer of the CPWG makes it an ideal candidate for interfacing the RFIC microwave ports. The grounded part of the CPWG enables the separation between the electromagnetic signal path and the FR-4 reinforcement section. Another advantage of the CPWG is its low radiation losses compared to regular microstrip structures.

Another type of transmission line that can be used is a slot-line. The slot line is advantageous in that it has lower propagation loss.

Reference is now made to FIG. 5, which is a simplified diagram showing a side view of the embodiment of FIG. 4. Parts that are the same as in previous figures are given the same reference numerals and are not discussed again except as necessary for an understanding of the present embodiments. As shown, there is a ground layer 16, a low loss substrate 18, a flip chip RFIC (packaged or unpackaged 10, RFIC bumps 28, 30 a contact location 20, a wave guide feed 26, a waveguide location 22, a cavity for the backshort, 38, screws, a metal casing, 40, a cavity 34, a coplanar wave-guide transmission line 24, cavity metal plating 36, a printed circuit board PCB (FR4) 14 and metal waveguide 12. The ground plane 50 is above the millimeter wave substrate, thus obviating the need for tunneling through the substrate at the RFIC. On the other hand via 41 tunnels through the substrate in order to connect the ground plane with the cavity metal plating 36.

In accordance with the embodiments of FIGS. 4 and 5, there is provided a method of manufacturing a connection for a waveguide to a PCB, comprising:

printing a feed onto a low loss substrate a feed, the feed being an extension of a transmission line;

cutting a cavity underneath the feed into the PCB structure;

providing a metal plating around the cavity walls;

laminating the low loss substrate onto the PCB after the metal plating has been provided, thus ensuring that the metal plating extends between the laminated layers around the cavity. This is followed by placing a metal cap over the substrate. The metal cap may then be electrically connected to the metal plating. This is followed by placing the waveguide in contact with the cavity such that the cavity forms a continuation with the waveguide.

The metal cap may then be connected to the metal plating using vias which are located within the radius of the laminated layers. The vias ensure electrical conduction between the metal cap and the metal plating to provide a continuous ground layer.

The combination of flip-chip connections, microstrip or CPWG transmission line and waveguide feed may provide a significant reduction in power loss as compared with conventional designs. The combination is also easier to simulate than conventional designs. In particular the use of connection bumps helps to minimize parasitic reactance and radiation and reflection losses at the interface.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A device comprising:

a low loss substrate comprising, on a first side, a contact location for a mm-wave integrated circuit, and on a second side, a waveguide location;

a planar transmission line extending along said first side from said contact location to above said waveguide location as a monopole waveguide feed; wherein the planar transmission line including said monopole waveguide feed extends along a single planar conducting layer;

connection bumps configured to connect said mm-wave integrated circuit to said low loss substrate at said contact location;

a soft laminate comprising a second cavity located below the waveguide location; the second cavity configured to receive a wave transmission from the waveguide feed and forward said wave transmission to a waveguide located below the second cavity; and a back-short located essentially above the waveguide location; the back-short comprises a first cavity of depth equivalent to about a quarter wave-length, and is configured to reflect energy into said waveguide.

2. The device of claim 1, wherein said connection bumps belong to a flip chip interconnection of said mm-wave integrated circuit, and the low loss substrate comprises a soft material.

3. The device of claim 2, wherein a ground connection to said mm-wave integrated circuit is made through the low loss substrate to at least one of the connection bumps.

4. The device of claim 1, wherein the planar transmission line is a ground-signal-ground transmission line.

5. The device of claim 1, wherein the waveguide feed is an impedance matched monopole waveguide feed, the first cavity is an air cavity, and the second cavity is a metal plated air cavity.

6. A method comprising:

providing a soft laminate having a thickness which is substantially a quarter of a predetermined wavelength to be transmitted through a waveguide;

printing a feed on a low loss substrate, the feed being an extension of a planar transmission line; wherein the planar transmission line including the feed extends along a single planar conducting layer;

cutting a second cavity into the soft laminate;

laminating the low loss substrate onto the soft laminate after cutting said second cavity, such that the second cavity is under the feed and the low loss substrate, and the low loss substrate being essentially self-supported over the second cavity;

placing a back-short above the low loss substrate and the second cavity, wherein the back-short comprises a first cavity of depth equivalent to about a quarter wave-length; and coupling the waveguide to the second cavity such that the second cavity forms a continuation with the waveguide.

7. The method of claim 6, wherein said low loss substrate comprises a millimeter wave substrate such that said planar transmission line is mounted on said millimeter wave substrate; and wherein the cutting of the second cavity into the soft laminate further comprises plating the second cavity with metal.

8. A method comprising:

printing a feed on a second side of a low loss substrate, the feed being an extension of a planar transmission line; wherein the planar transmission line including the feed extends along single planar conducting layer;

cutting a second cavity into a soft laminate;

providing a metal plating around said second cavity;

laminating a first side of the low loss substrate onto the soft laminate after said metal plating has been provided;

placing a back-short comprising a first cavity of depth equivalent to about a quarter wave-length on the second side of the low loss substrate, the back-short being electrically connected to the metal plating, and the first cavity is essentially above the second cavity; and placing a waveguide in contact with the second cavity such that the second cavity forms a continuation with the waveguide.

9. The method of claim 8, further comprising connecting said back-short to said metal plating using electrical connections.

10. A low-loss interface comprising:

a low loss substrate comprising, on a first side, a contact location for an integrated circuit, and on a second side, a waveguide location;

a planar transmission line extending along said first side from said contact location to above said waveguide location as a monopole waveguide feed; wherein the planar transmission line including said monopole waveguide feed extends along a single planar conducting layer;

a back-short electrically coupled to the first side and located essentially above the waveguide location; the back-short comprises a first cavity of depth equivalent to about a quarter wave-length;

a soft laminate comprising a second cavity coupled to the waveguide location; and a waveguide coupled to and continuous with the second cavity.

11. The low loss interface of claim 10, further comprising a connection bump on the first side, providing a connection between a mm-wave integrated circuit and the planar transmission line, thereby providing the low loss interface; and said connection bump is one of a plurality of connection bumps of a flip chip interconnection system associated with said mm-wave integrated circuit.

12. The low loss interface of claim 11, wherein a ground connection to said mm-wave integrated circuit is provided through said low loss substrate to another of said plurality of connection bumps, and the low loss substrate comprises a soft material.

13. The low loss interface of claim 10, wherein the waveguide feed is an impedance matched monopole waveguide feed.

14. The low loss interface of claim 10, wherein said back-short is configured to reflect energy into the waveguide, the first cavity is an air cavity, and the second cavity is a metal plated air cavity.

15. A method comprising:

printing a feed on a low loss substrate, the feed being an extension of a planar transmission line, and the low loss substrate being non-ceramic; wherein the planar transmission line including the feed extends along a single planar conducting layer;

cutting a second cavity into a soft laminate;

metal plating around said second cavity;

laminating the low loss substrate onto the soft laminate after said metal plating, such that the second cavity is under the feed and the low loss substrate;

placing a back-short above the low loss substrate and the second cavity, wherein the back-short comprises a first cavity of depth equivalent to about a quarter wave-length; and coupling a waveguide to the second cavity such that the second cavity forms a continuation with the waveguide.

16. The method of claim 15, further comprising electrically connecting the back-short to the metal plating.

17. The method of claim 15, wherein the low loss substrate comprises a millimeter wave substrate, and the planar transmission line is located on the millimeter wave substrate; and wherein the second cavity functions as part of a laminated structure with the millimeter wave substrate.

* * * * *